US005727923A

United States Patent [19]

Michel

[11] Patent Number: 5,727,923

[45] Date of Patent: Mar. 17, 1998

[54] COLLECTING DEVICE FOR SHEETS

[75] Inventor: Bernd Michel, Gablingen, Germany

[73] Assignee: Böwe Systec AG, Augsburg, Germany

[21] Appl. No.: 495,610

[22] PCT Filed: Jan. 25, 1994

[86] PCT No.: PCT/EP94/00190

§ 371 Date: Jul. 19, 1995

§ 102(e) Date: Jul. 19, 1995

[87] PCT Pub. No.: WO94/16981

PCT Pub. Date: Aug. 4, 1994

[30] Foreign Application Priority Data

Jan. 27, 1993 [DE] Germany ..... 9301071 U
Jan. 27, 1993 [DE] Germany ..... 9301072 U

[51] Int. Cl.[6] ..... B65H 31/40

[52] U.S. Cl. ..... 414/789.9; 271/220; 271/274

[58] Field of Search ..... 271/198, 212, 271/220, 273, 266, 274; 414/790.7, 789.9; 198/781.08

[56] References Cited

U.S. PATENT DOCUMENTS

| | | | |
|---|---|---|---|
| 4,621,966 | 11/1986 | Luperti et al. | 271/213 |
| 4,640,506 | 2/1987 | Luperti et al. | 271/212 |
| 4,750,853 | 6/1988 | Van Soest et al. | 271/220 |
| 4,896,876 | 1/1990 | Yamada et al. | 271/266 |
| 5,080,347 | 1/1992 | Funada | 271/266 |
| 5,147,092 | 9/1992 | Driscoll et al. | 271/198 |
| 5,178,379 | 1/1993 | Edwards et al. | 271/198 |
| 5,402,996 | 4/1995 | Long | 271/266 |
| 5,588,523 | 12/1996 | Hara et al. | 198/781.08 |

FOREIGN PATENT DOCUMENTS 2 013 810 2/1972 Germany .

*Primary Examiner*—Karen B. Merritt
*Assistant Examiner*—Gregory A. Morse
*Attorney, Agent, or Firm*—McGlew and Tuttle

[57] ABSTRACT

The present invention pertains to a collecting device for sheets 3 for forming stacks of sheets 6 from individual sheets 3 fed in at a stop 26, as well as with a removing device 28 for the stacks 6 formed. To remove the stacks of sheets 6 with a high reliability of operation, the present invention provides for a movable stop 26 and a driven roller arrangement 29, 30, 31, which is mounted such that it can be fed to the stack of sheets 6. On the other hand, the present invention discloses a special, elastic conveying means 8, 11, which guides the sheets 3 onto the stack of sheets 6 along a transport path 7 and over a deflector 16. Both measures can be embodied both as a combination and separately.

20 Claims, 7 Drawing Sheets

COLLECTING DEVICE FOR SHEETS

FIELD OF THE INVENTION

The present invention pertains to a collecting device for sheets to form stacks of sheets, with a removing device.

BACKGROUND OF THE INVENTION

Such a collecting device has been known from practice. It is used to form stacks of sheets from individual sheets fed in. After completion of the stacking job, the stack of sheets is removed with the removing device. The prior-art removing device consists of two rollers, which also form the stop for the stack of sheets with their wedge. The rollers are driven intermittently, and they pull off the stack from the delivery area. This arrangement has the disadvantage that the roller wedge does not offer a clean stop surface. The rollers also must have a certain minimum size to be able to grip and remove the stack of sheets. It is also unfavorable that the roller drive must be switched on and off intermittently.

On the other hand, it has been known that individual sheets can be pushed over a ramp and be allowed to slide or fall onto the stack of sheets located lower. The sheets are driven by rollers only in the ramp area, and they are pushed onto the stack of sheets. This technique requires relatively high rigidity of the sheet. Furthermore, it is also suitable only for placing the sheets on a stack on one side only. In addition, a change in format requires a considerable effort in terms of conversion.

SUMMARY AND OBJECTS OF THE INVENTION

It is an object of the present invention to provide a removing device with a higher reliability of operation.

Another object of the present invention is to provide a collecting device with reliable sheet guidance and optionally selectable delivery of the sheets on the stack.

The removing device according to the present invention provides a separate stop, which is movable and can be removed to remove the stack of sheets. The stop, which is preferably designed as a pivotably driven plate, ensures better alignment of the stack of sheets, which can also be gripped better and more securely as a result. A driven roller arrangement, which can be fed to the stacks of sheets, is provided for the transportation of the stack of sheets. It is out of operation during the stacking job, and it is brought into conveying contact with the finished stack of sheets only for the removal of the finished stack of sheets. The roller arrangement itself has no stop function any more, and it no longer has to grip the stack of sheets at the front edge of the sheet. It can be positioned somewhat farther away from the edge in the area of the stacking surface, as a result of which it grips the stack of sheets better and more securely. Due to the possibility of feeding the roller arrangement, the latter does not hinder the stacking job, which can take place trouble-free and at a high reliability of operation as a result.

Three rollers are preferably provided; two of them clamp the stack of sheets between them and are then driven by a third drive roller. As a result, it is possible to uncouple the gripping and clamping movement of the stack of sheets from the transport movement, and to allow the two processes to take place one after the other. This improves the reliability of operation during the gripping and guiding of the stack of sheets, which can no longer fan out during the pulling off.

A single actuating device, which removes the stop and feeds and puts into operation the individual rollers, is provided for the removing device. It is possible in the arrangement according to the present invention to provide a continuously rotating drive roller and to bring about the intermittent delivery operation by cyclically feeding the roller. This technique is more efficient in terms of control and mechanics. The reliability of operation, as well as the service life and consequently the economy increase compared with the prior art.

Various design possibilities are available for the arrangement of the rollers and of the stop and their feeding movement. In the preferred embodiment, the lower pressure roller is coupled with the stop. The stop is arranged in this case such that it is turned out of the area of the path of the paper before the removing movement is performed by the combination of rollers. The three rollers are located one on top of another in one line in the preferred embodiment, and they are brought into contact with one another by a single rotating feeding movement of the lower pressure roller. Springloaded mounting of the intermediate roller is recommended for this purpose. This is achieved by the correct dimensioning of the support shaft. Thus, the stack of sheets is first tensioned over the feed path of the pressure roller, and the frictional and driving contact with the drive roller is established only thereafter.

The removing device according to the present invention may be combined with various devices for forming a stack. The preferred embodiment provides for a deflector and at least one elastic conveying means, which moves together with it and guides and transports the sheet fed in over the entire path from its entry into the collecting device until it is deposited on the stack of sheets. As a result, the sheets of the stack are kept continuously in contact with the stop and are flatly aligned on it with their front edges. The conveying means, which are preferably designed as a belt arrangement, are preferably supported from below on the stack of sheets. This facilitates the arrangement and the function of the removing device according to the present invention.

According to features of the invention, the individual sheet fed in is transported over the entire transport path within the collecting device by an elastic conveying means moving together, preferably a belt arrangement. The reliability of transport is essentially increased as a result, and the sheet may also have a low intrinsic stability and low shear strength and creaseproofness.

The sheet is moved by the conveying means to the stack of sheets via a deflector with an oblique guide surface. The deflector may project in the downward or upward direction, and thus it can make it possible for the sheet to come into contact with the underside or the top side of the stack of sheets. The stack of sheets can thus be built up as desired.

The deflector is reversible in a particularly preferred embodiment of the present invention. It can at least be brought from the deflecting position into a neutral horizontal position, which makes it possible for the sheets to pass through without any collection activity. As a result, the collecting device can be better integrated within a processing line, and switches, bypasses, etc., can be eliminated.

In the preferred embodiment, the deflector can be brought into the neutral position and into two deflecting positions in the upward and downward directions, as a result of which the direction of delivery at the bottom/at the top can be changed as desired during the stacking job. The sequence of sheets within the stack can be changed as a result.

The deflector may have various designs. In the preferred and especially simple, reliably operating and efficient embodiment, it consists of a pivoting flap, which can be pivoted, as desired, into a deflecting position in the upward or downward direction, but also into the neutral middle position. The pivoting flap makes it possible, in particular, to switch over the direction of delivery during the stacking job. It can be actuated manually, but also automatically via a programmable and/or remotely controllable machine control.

The deflector preferably has, especially in the form of the pivoting flap, a plurality of wings, which are arranged laterally at spaced locations from one another, in the spaces between which the conveying means extend. This is advantageous especially for a reversible deflector. It is recommended that both the wings and the conveying means be transversely adjustable for adjustment to different format widths.

The collecting device may be equipped with one or two conveying means. Arrangement on one side may be sufficient if the stack of sheets is always built up from one side only. The double arrangement offers the advantage over this that the individual sheet being fed in is gripped from both sides at least in the entry area, so that it is transported particularly securely onto the deflector. In addition, the stack of sheets can rest on the lower conveying means, and it needs no additional support means. It is also advantageous in this connection that the stack of sheets is always conveyed in the forward direction toward the stop from both sides and is thus stabilized.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
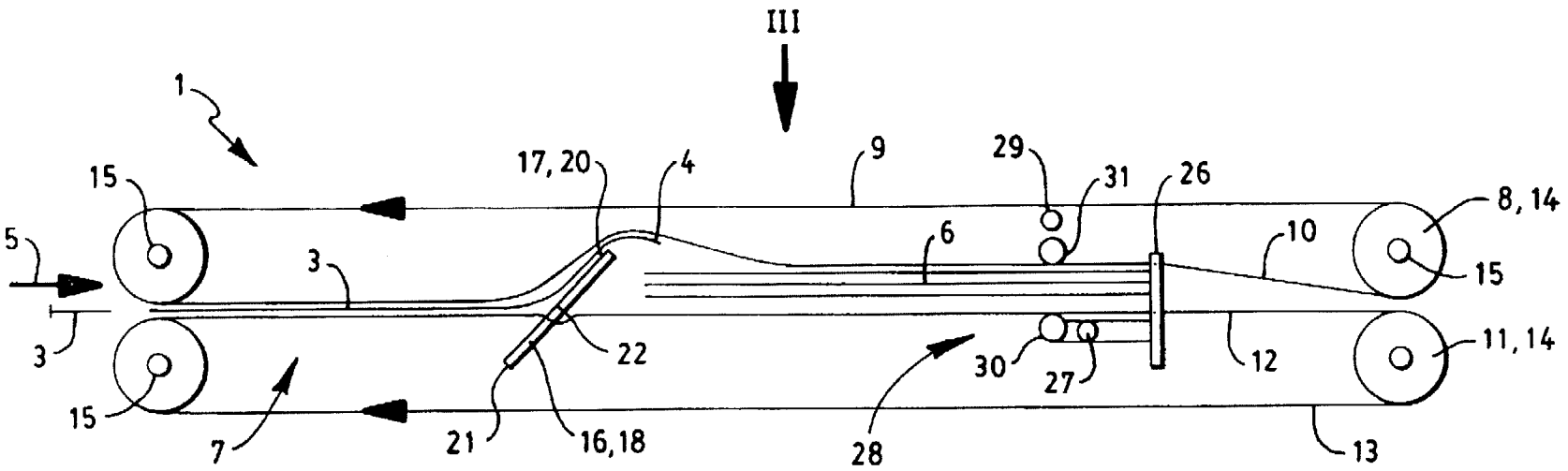
FIG. 1 is a side view of the collecting device with the deflector in the upright position for placing sheets on the top side of the stack of sheets.

FIG. 1 shows a collecting device 1, in which sheets 3 fed in one by one are collected into a stack of sheets 6 and are then removed together. The sheets 3 fed in may be of different types. In the preferred exemplary embodiment, they are sheets of paper. However, they may also be plastic films or other sheet-like materials with a certain flexibility.

The collecting device 1 has a transport section 7, which is followed by a deflector 16 for deflecting the individual sheets 3 fed in. The stack of sheets 6 or the delivery area with a front-side stop 26 and with a removing device 28 is arranged at a short distance behind the deflector 16. The collecting device 1 also has two elastic conveying means 8, 11, which move together over the length and are located above each other.

In the preferred embodiment, the conveying means 8, 11 consist of a plurality of rotatingly driven, endless belts of a preferably round cross section, which are arranged next to each other. As an alternative, they may also be flat belts or any other suitable conveying means, which guide and drive the sheet 3 over its entire path of movement in the collecting device 1.

Figure 5:
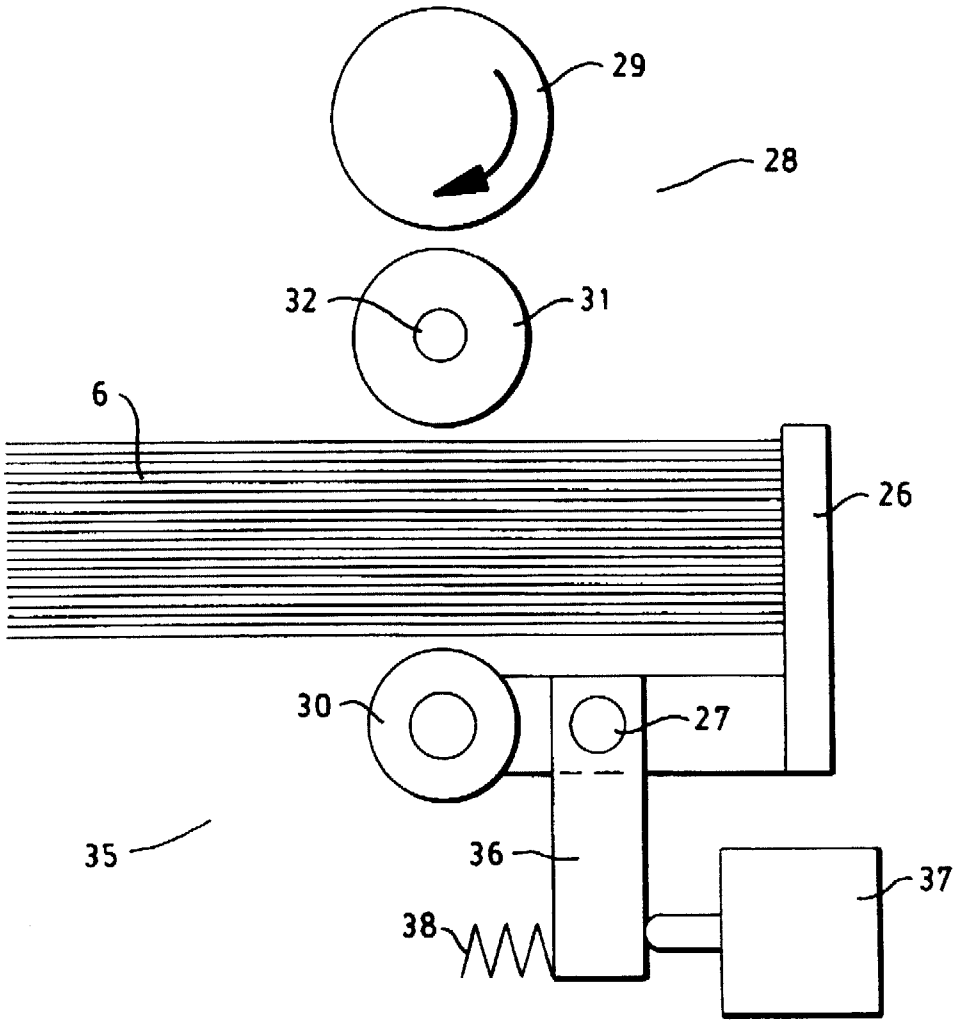
Figure 6:
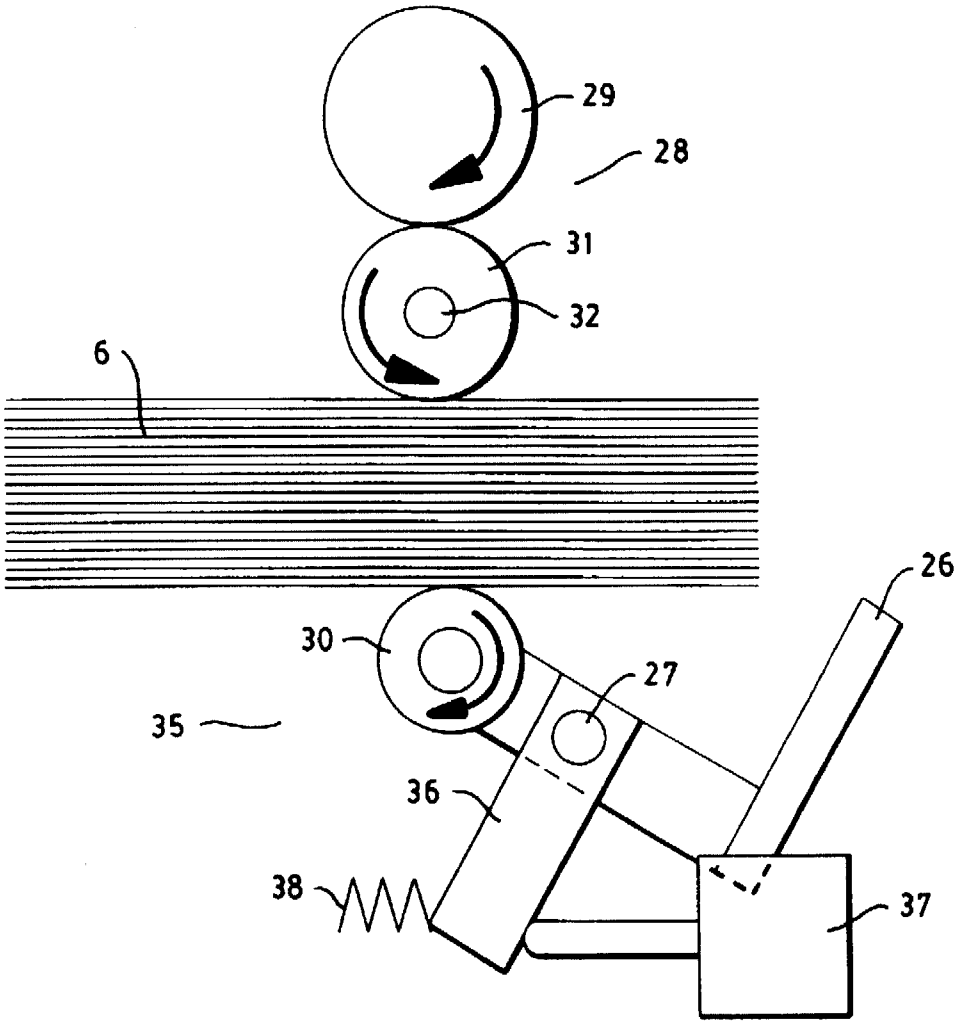
Figure 7:
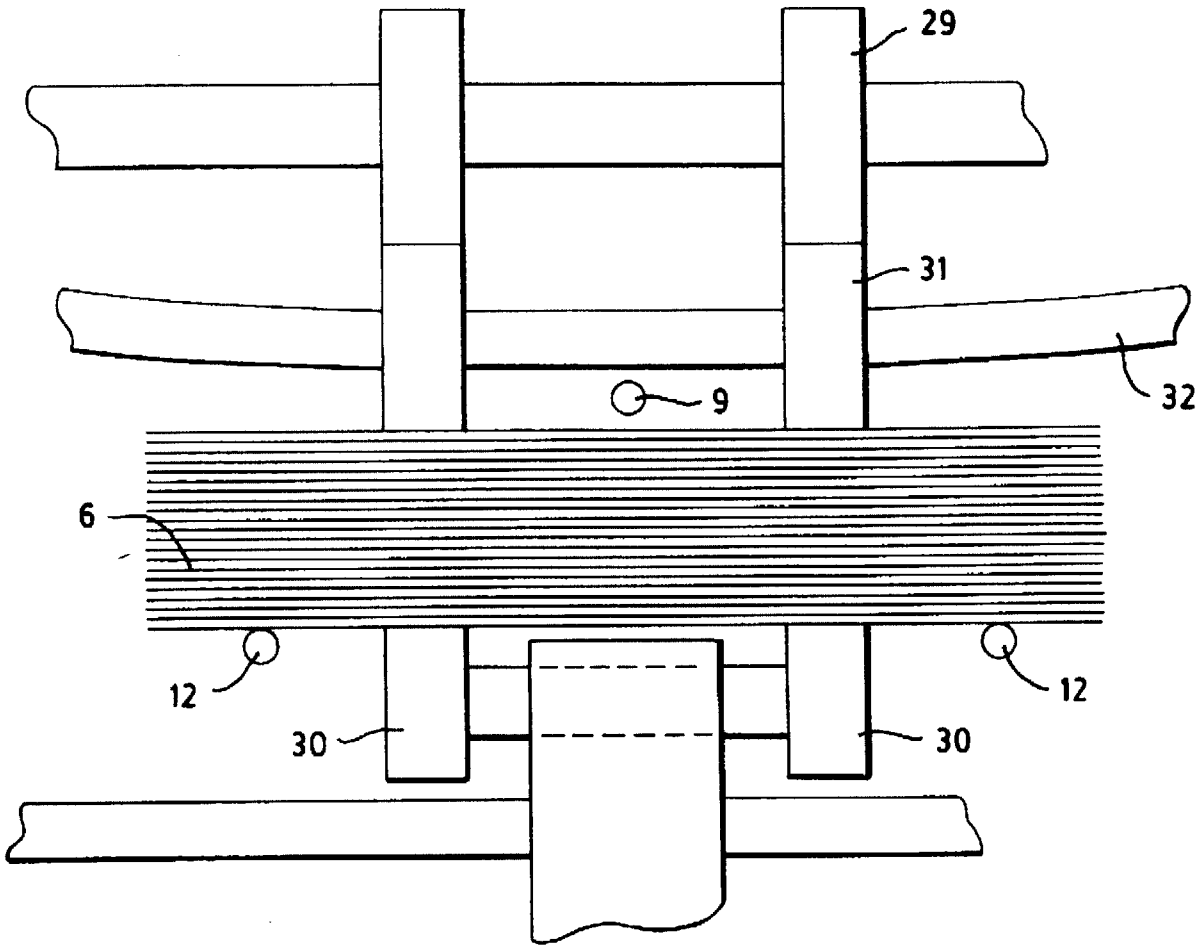

FIGS. 5 through 7 illustrate the removing device 28. It consists of a roller arrangement 29, 30, 31, an actuating device 35, and an integrated stop 26.

Figure 3:
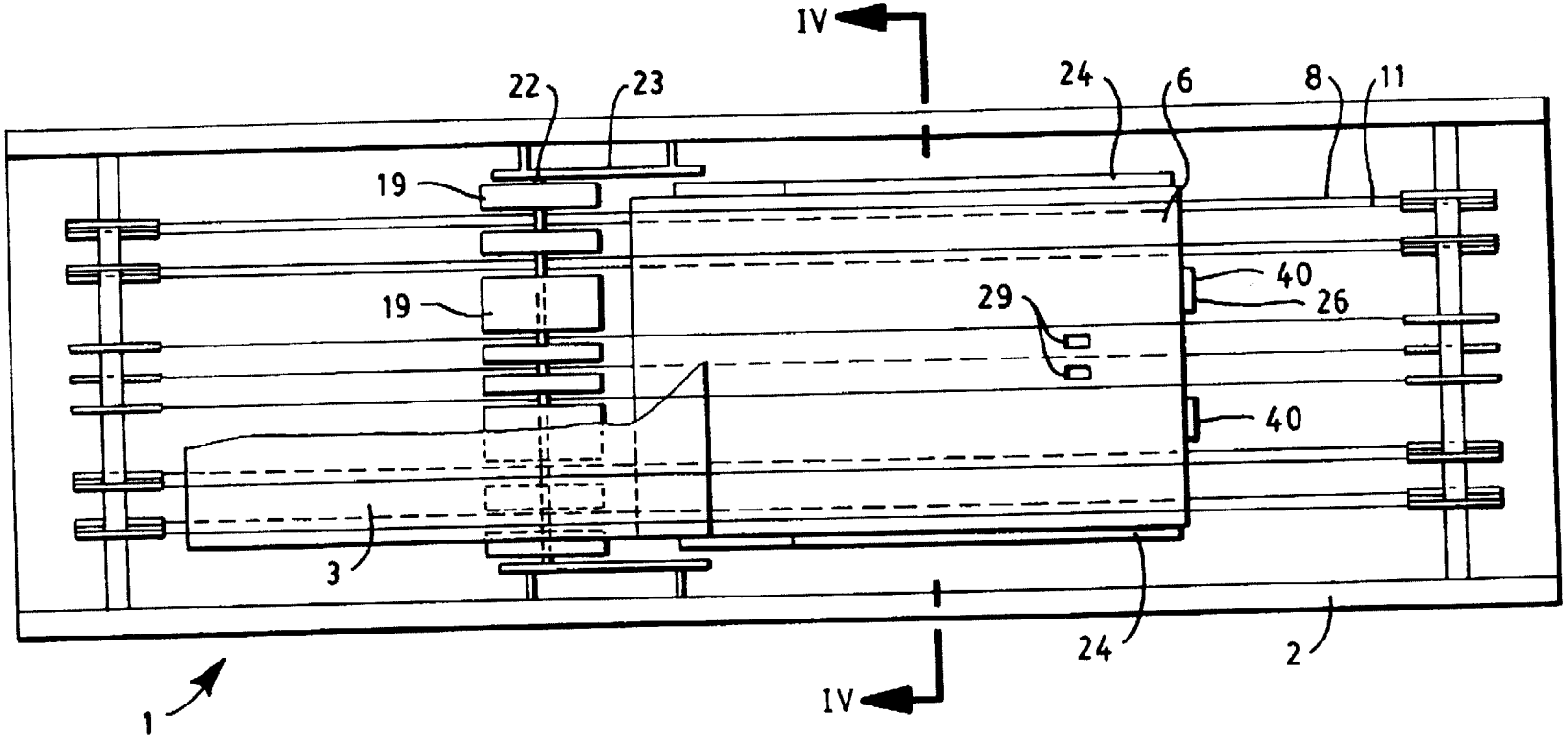
FIG. 3 is a top view of the collecting device according to arrow III in FIG. 1.

The stop 26 is designed as a plate and it offers a vertical and flat support surface for the stack of sheets 6. The stop 26 may be removed for removing the finished stack of sheets 6. It is mounted, e.g., pivotably for this purpose, and it is provided with a suitable drive 37, which folds the stop 26 away upon receiving a corresponding control signal from the control system of the machine or unit. This arrangement is shown in FIGS. 5 and 6. FIG. 3 illustrates that the stop 26 consists, similarly to the deflector 16, of a plurality of stop wings 40, which are arranged laterally at spaced locations from one another and allow the belts 8, 11 to pass through between them.

To remove the stack of sheets 6 rapidly and securely, the removing device 28 is provided with a roller arrangement 29, 30, 31, which can be fed. It is located at a spaced location from the front edge of the stack of sheets 6 and is offset in the rearward direction against the direction of transport 5.

FIGS. 5 through 7 illustrate the design of the roller arrangement. It consists of a total of three rollers 29, 30, 31, which may also be designed as divided rollers corresponding to FIG. 7. The axes of the three rollers 29, 30, 31 are arranged in one line vertically one above the other. Two rollers 30, 31, which are preferably lifted off from the stack of sheets 6 in the released position shown in FIG. 6, are located above and under the stack of sheets 6. They could also be in a loose contact.

A continuously rotating drive roller 29, which rotates in the direction indicated, is arranged above the so-called intermediate roller 31 in the exemplary embodiment shown. There is no drive connection between the two rollers 29, 31 during the stacking job. With its axis 32, designed as a spring element, the freely rotatable intermediate roller 31 is mounted in a bearing 33 on the frame 2.

A so-called pressure roller 30, which is mounted freely rotatably, is moved by an actuating device 35, and can be pressed against the stack of sheets 6, is arranged under the stack of sheets 6. The actuating device may have various designs.

In the exemplary embodiment shown, it has a pivoted lever 36, to which the pressure roller 30 is fastened. At its end, it is acted upon by a single drive 37, preferably an electromagnet, against a resetting spring 38. During actuation, the drive 37 pivots the lever 36, and the latter pivots the stop out of the plane of conveyance. The pressure roller 30 is then pressed against the stack of sheets 6.

The intermediate roller 31 is disengaged with the drive roller 29 in the collection position. For removal, the stack of sheets 6 is also moved slightly upward with the pressure roller 30, as a result of which it is clamped between the rollers 30, 31. During further actuation and lowering, the intermediate roller 31 is brought into frictional contact with the drive roller 29. As a result, the intermediate roller 31 is set into rotation, and it pushes off the stack of sheets 6 clamped between the rollers 30, 31 in the direction of transport 5. The stack of sheets 6 stays together and cannot fan out due to the pressure roller 30.

After the magnet 37 has been released, the three rollers 29, 30, 31 will again become disengaged by the resetting spring forces, and they assume the starting position shown in FIG. 5.

The removing device 28 is integrated within the collecting device 1 such that it is arranged between the belts 8, 11 and cooperates with same. As is shown by the cross section in FIG. 7, the empty run 10 of one of the upper belts 8 passes through the divided pressure roller 30. The two carrying runs 12 of the adjacent lower belts 11 on both sides extend outside the intermediate roller 31 on both sides and over its axis 32. The removing device 28 and the three belts 8, 11 are preferably arranged centrally to the stack of sheets 6. The conveying means 28 can be laterally displaced in the case of changes in format.

The stacking technique cooperating with the removing device 28 will be explained in greater detail below.

The individual sheets 3 are fed from the outside in the direction of transport 5 over a conveying section, not shown in detail. On the entry side of the collecting device 1, they reach the transport path 7 between the upper conveying means 8 and the lower conveying means 11. The two conveying means 8, 9 move synchronously; they clamp the sheet 3 between them and deliver it to the deflector 16 in the direction of transport 5.

In the exemplary embodiment shown, the deflector 16 is comprised of a pivoting flap 18, which is rotatably mounted around a preferably central axis 22 at right angles to the direction of transport 5 and is driven manually or mechanically by means of a device, not shown. The pivoting flap 18 has a plurality of wings 19, which are arranged at spaced locations next to each other on the axis 22. In the flap position shown in FIGS. 2 and 3, the obliquely positioned wings 19 form deflecting surfaces 17 in the direction of transport 5, over which the sheet 3 is conveyed and deflected from its horizontal path. A neutral flap position in the horizontal position, which makes it possible for the sheets 3 to pass through without collection activity, is also possible.

In the flap position shown in FIG. 1 with the rear edge 20 raised, the sheet 3 is guided to the stack of sheets 6 for so-called upward collection, and it is delivered on the top side of the stack. The lowered front end 21 forms a ramp for securely deflecting the sheets.

Figure 2:
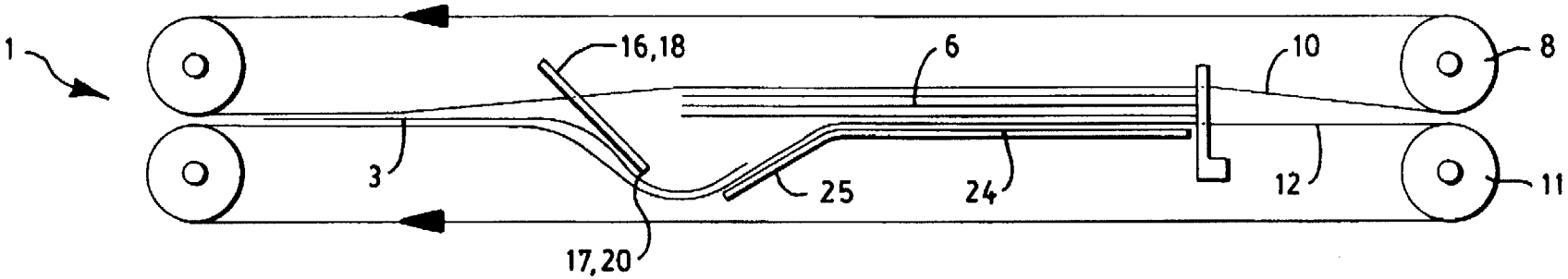
FIG. 2 is a variant of FIG. 1 with a deflector in the low position, with sheet delivery from below.

The rear edge 20 is lowered in the embodiment according to FIG. 2, as a result of which the sheet 3 is deflected downward for so-called downward collection, and it is brought into contact with the lower side of the stack of sheets 6.

Figure 4:
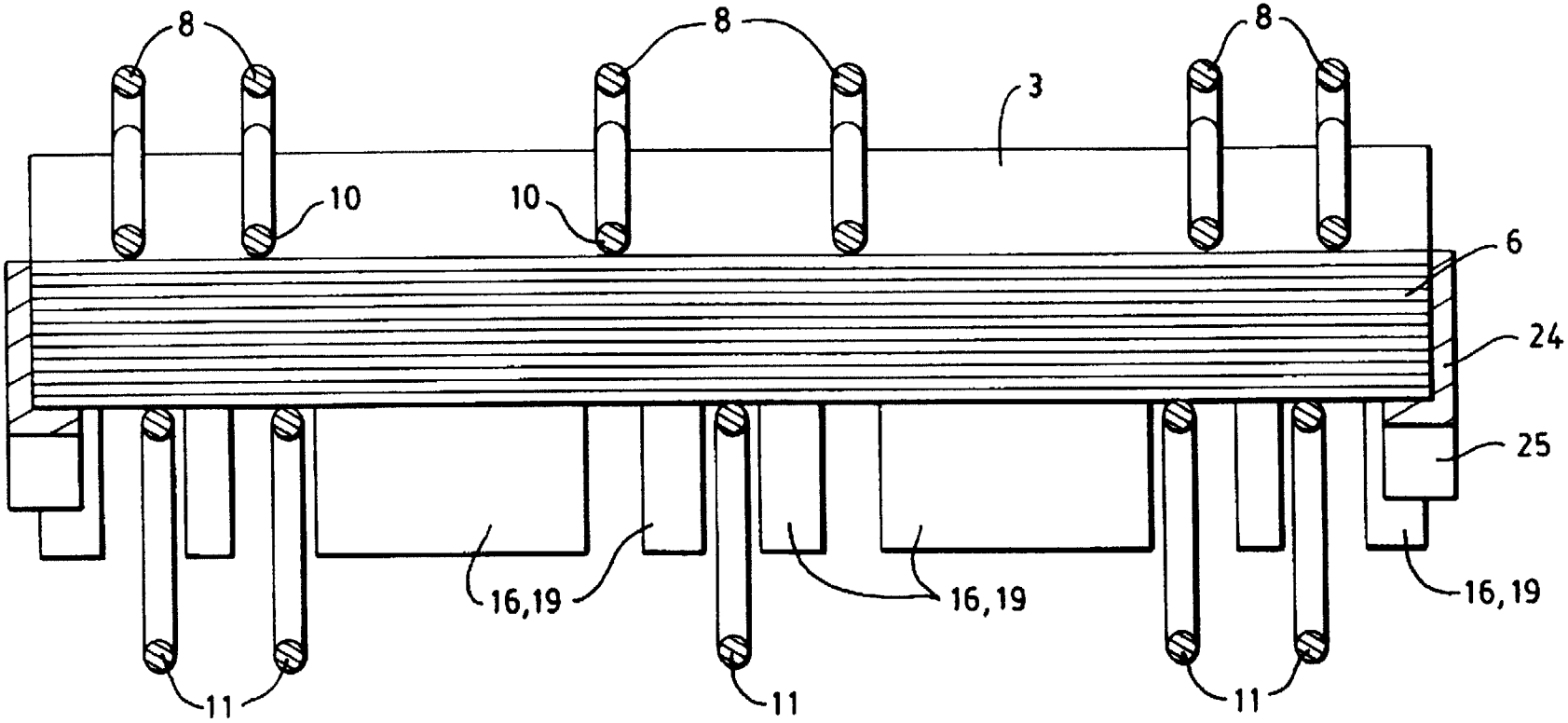
FIG. 4 is a cross section of the collecting device along the sectional line IV—IV in FIG. 3, and FIGS. 5 through 7 are various representations of a conveying device with a stop.

As is illustrated in FIGS. 3 and 4, the wings 19 are arranged on their axis 22 at spaced locations next to each other. The belts 8, 11 extend through the spaces. For adjustment to different format widths, the wings 19 may be mounted laterally displaceably on the axis 22. The belt pulleys 14 are correspondingly also mounted laterally displaceably on their axes 15. The belt pulleys 14 belonging to one conveying means 8, 11 are mounted on a common axis 15 on the entry and exit side of the collecting device 1.

When a sheet 3 is delivered with its front edge 4 onto the deflector 16 and is deflected upward or downward from the plane of the transport path, the corresponding conveying means 8, 11 is correspondingly deflected and lifted out of the space between the wings 19 as well. The belt 8, 11 is now tensioned, and the pressing and conveying force acting on the sheet 3 is thus increased.

In the exemplary embodiment according to FIG. 1, the empty run 10 of the upper belts 8 with the sheet 3 is deflected. It describes with the sheet 3 an arc over the deflector 16, which is raised with its rear edge 20 slightly above the level of the stack of sheets 6. The empty run 10 then comes again into contact with the top side of the stack of sheets 6 and pushes its top sheet against the stop 26. As a result, the sheets 3 are in conveying engagement with the upper belt 8 continuously and over their entire length from the time of entry into the collecting device 1 until delivery on the stack of sheets 6.

The carrying run 12 of the lower belt comes into contact with the sheet 3 from below on the entry-side transport path 7. To generate a certain contact pressure here, the entry-side belt pulleys 14 are arranged at spaced locations from one another such that the empty run 10 of the upper belt 8 and the carrying run 12 of the lower belt 11 extend essentially at the same level. The distance between the belts may be greater on the exit side, depending on the thickness of the stack.

In the exemplary embodiment according to FIG. 1, the carrying run 12 of the lower belt 11 is again separated from the sheet 3 at the axis 22, and it passes by the deflector 16 without any essential deflection in the space between the wings 19. The carrying run 12 subsequently comes into contact with the stack of sheets 6 from below, and it is deflected into the empty run 13 at the end-side belt pulley 14 behind the stop 26.

The stack of sheets 6 is uniformly held and supported by the carrying runs 9 of the lower belts 11, which carrying runs are uniformly distributed over the width. At the same time, the lower sheet is continuously propelled against the stop 26. The belt support may be sufficient for the stack of sheets 6. However, angular support rails 24, which support the stack of sheets 6 at the edge and additionally guide it laterally, may be additionally arranged at the two longitudinal edges of the stack of sheets 6. The support rails 24 extend approximately at the level of the carrying run 12 of the lower belts 11.

For downward collection, the deflector 16 with its rear edge 20 is pivoted downward, corresponding to FIG. 2. The sheet 3 arriving is thus deflected in the downward direction, and the carrying run 12 of the lower belts 11 is now deflected and tensioned. The sheet 3 is brought to and placed on the stack of sheets 6 by the carrying run 12 from below.

To improve and facilitate the guiding of the sheets, the support rails 24 may have at their ends a ramp 25, which is bent angularly down and along which the sheet 3 slides to the stack 6.

During downward collection, the empty run 10 of the upper belt 8 extends between the wings 19 and is deflected in its horizontal position only by the stack of sheets 6, with the top sheet of which it continues to be in contact.

For adjustment to different length formats of the sheets 3, the deflector 16 can be adjusted in the direction of transport 5. To do so, the axis 22 is held in lateral bearing plates, which are arranged longitudinally displaceably on the frame 2. They can be locked in a desired position by means of a suitable fixing means. Positions may be preset for standard formats by means of suitable markings, such as notches or the like.

In a variant of the embodiment shown, it is also possible to arrange a plurality of deflectors 16, e.g., two, one behind the other in the direction of transport 5. This is especially meaningful and useful when different sheet lengths are to be collected within one stacking job, e.g., cover letters in DIN A 4 format and remittance slips or the like in a shorter format. If, e.g., the short format arrives as the first sheet, the deflector that is the first deflector in the transport direction 5 is brought into a neutral central position, which permits the sheet to pass through without deflection. The second deflector may also be in the horizontal position for the first short sheet. It is adjusted upward or downward when the next short sheet arrives, corresponding to the desired direction of collection.

When a longer sheet arrives, the position of the deflector will not change first. However, the deflector that is the second deflector in the direction of transport 5 is brought into the horizontal position, and the first deflector is brought into the oblique position in the desired direction of collection. The different forms can be collected upward and/or downward in the desired order by bringing the deflectors into the corresponding positions.

Various modifications of the exemplary embodiments shown are possible.

The removing device 28 shown in the roller arrangement can be inverted mirror-symmetrically, in which case the drive roller 29 is arranged above the stack of sheets. Furthermore, the roller movements may also be uncoupled, with the two rollers 30, 31 clamping the stack of sheets and the drive roller 29 being fed separately by a separate drive.

In addition, it is possible to position the drive roller 29 laterally offset and even between the two rollers 30, 31 associated with the stack of sheets 6. The two rollers 30, 31 are fed to the stack of sheets 6, and thus their axes come into contact with the drive roller 29, individually or together. In the case of joint contact, the stack of sheets is driven on both sides, and the direction of rotation of the rollers is equalized via intermediate gears.

Other feeding movements of the rollers among each other also possible, e.g., by feeding the drive roller 29 by an axial movement. Finally, no direct contact needs to be established between the rollers, and the drive roller may also act directly on the axis of the roller to be driven, or via an additional contact wheel, e.g., a conical friction wheel for axial feeding.

In another modification, the intermediate roller 31 may be abandoned, and the drive roller 29 may be pressed intermittently directly against the stack of sheets 6.

It is also possible to mechanically uncouple the feeding from the stop and the removing device and to actuate it via a plurality of drives. The correct order of the activation must be determined via a machine or unit control.

On the other hand, when one direction of collection has been selected, the deflector may be designed as a rigid deflector, or it may be movable only between a deflecting position and the horizontal position. It may also have a continuous wing without spaces.

The deflector or its wings may also consist of height-adjustable fingers or the like, with oblique guide surfaces. These fingers may be fed from the top and from the bottom for bilateral collection.

In the case of only one direction of collection, a single conveying means, which conveys the sheet via the deflector and onto the stack of sheets, may be sufficient.

While specific embodiments of the invention have been shown and described in detail to illustrate the application of the principles of the invention, it will be understood that the invention may be embodied otherwise without departing from such principles.

LIST OF REFERENCE NUMBERS

1 Collecting device
2 Frame
3 Sheet
4 Front edge
5 Direction of transport
6 Stack of sheets
7 Transport path
8 Conveying means, top, belt
9 Carrying run
10 Empty run
11 Conveying means, bottom, belt
12 Carrying run
13 Empty run
14 Belt pulley
15 Axis
16 Deflector
17 Guide surface
18 Pivoting flap
19 Wing
20 Rear edge
21 Front edge
22 Axis
23 Bearing plate
24 Support rail
25 Ramp
26 Stop
27 Drive
28 Removing device
29 Roller, drive roller
30 Roller, pressure roller
31 Roller, intermediate roller
32 Spring shaft
33 Bearing
34
35 Actuating device
36 Pivoted lever
37 Drive, electromagnet
38 Resetting spring
39 Traverse
40 Stop wing

I claim:

1. A device for removing stacks of sheets collected from individual sheets, comprising:

a movable stop;

a driven roller arrangement including two rollers mounted to be engaged with the stack of sheets and a third, continuously driven drive roller, said stack of sheets being clamped between said two rollers of said driven roller arrangement and, said two rollers being mounted freely rotatably and transversely movably, with one of said two rollers on each side of said stack of sheets, said movable stop being disposed adjacent to said driven roller arrangement; and an actuating device connected to said driven roller arrangement, at least one of said two rollers and said third, continuously driven drive roller of said roller arrangement, being brought intermittently into drive connection by said actuating device.

2. A device according to claim 1, wherein said actuating device acts to clamp said stack of sheets between said two rollers by positioning said two rollers in a clamp position, said actuating device bringing one of said two rollers into contact with said drive roller in said clamped position.

3. A device according to claim 2, wherein said actuating device includes a driven pivoted lever, one of said two rollers being a pressure roller, said pressure roller being connected to said driven pivoted lever.

4. A device according to claim 3, wherein said actuating device includes a drive for driving said pivoted lever, said drive including an electromagnet and a resetting spring.

5. A device according to claim 1, wherein said stop includes a plate and is connected to a stop drive.

6. A device according to claim 5, wherein said stop drive is formed by said actuating device with a coupling between said actuating device and said stop.

7. A device according to claim 5, wherein said coupling between said stop and said actuating device is mechanical.

8. A device according to claim 1, wherein at least one of said two rollers and said drive roller are arranged movably relative to one another.

9. A device to claim 1, wherein said roller arrangement includes three rollers arranged vertically one above the other.

10. A device according to claim 1, wherein two rollers includes an intermediate roller arranged between said stack of sheets and said drive roller, said intermediate roller being spring mounted on a shaft, said shaft generating a resetting force directed toward said stack of sheets based on said spring mounting.

11. A device for removing stacks of sheets from collected individual sheets, comprising:

a movable stop;

a driven roller arrangement including two rollers mounted to be engaged with the stack of sheets and a third, continuously driven drive roller, said stack of sheets being clamped between said two rollers of said driven roller arrangement and, said two rollers being mounted freely rotatably and transversely movably, with one of said two rollers on each side of said stack of sheets, said movable stop being disposed adjacent to said driven roller arrangement; and an actuating device connected to said driven roller arrangement, at least one of said two rollers and said third, continuously driven drive roller of said roller arrangement, being brought intermittently into contact by said actuating device to define a drive connection.

12. A device according to claim 11, wherein said actuating device acts to clamp said stack of sheets between said two rollers by positioning said two rollers in a clamp position, said actuating device bringing one of said two rollers into contact with said drive roller in said clamped position.

13. A device according to claim 12, wherein said actuating device includes a driven pivoted lever, one of said two rollers being a pressure roller, said pressure roller being connected to said driven pivoted lever.

14. A device according to claim 13, wherein said actuating device includes a drive for driving said pivoted lever, said drive including an electromagnet and a resetting spring.

15. A device according to claim 11 wherein said stop includes a plate and is connected to a stop drive.

16. A device according to claim 15, wherein said stop drive is formed by said actuating device with a mechanical coupling between said actuating device and said stop.

17. A device according to claim 11, wherein at least one of said two rollers and said drive roller are arranged movably relative to one another.

18. A device according to claim 11, wherein said roller arrangement includes three rollers arranged vertically one above the other.

19. A device according to claim 11, wherein two rollers includes an intermediate roller arranged between said stack of sheets and said drive roller, said intermediate roller being spring mounted on a shaft, said shaft generating a resetting force directed toward said stack of sheets based on said spring mounting.

20. A device for removing stacks of sheets from collected individual sheets, comprising:

a movable stop;

a driven roller arrangement including exactly three rollers with two rollers mounted to be engaged with the stack of sheets and a third, continuously driven drive roller, said stack of sheets being clamped between said two rollers of said driven roller arrangement and, said two rollers being mounted freely rotatably and transversely movably, with one of said two rollers on each side of said stack of sheets, said movable stop being disposed adjacent to said driven roller arrangement; and an actuating device connected to said driven roller arrangement, at least one of said two rollers and said third, continuously driven drive roller of said roller arrangement, being brought intermittently into contact by said actuating device to define a drive connection.

* * * * *